US008070338B2

(12) United States Patent
Boroczki et al.

(10) Patent No.: US 8,070,338 B2
(45) Date of Patent: Dec. 6, 2011

(54) THREE-MODE INTEGRATED HEADLAMP

(75) Inventors: Agoston Boroczki, Budapest (HU); Csaba Horvath, Budapest (HU); Tamas Panyik, Pest (HU)

(73) Assignee: General Electric Company, Schenectady, NY (US)

( * ) Notice: Subject to any disclaimer, the term of this patent is extended or adjusted under 35 U.S.C. 154(b) by 669 days.

(21) Appl. No.: 12/098,954

(22) Filed: Apr. 7, 2008

(65) Prior Publication Data

US 2009/0251915 A1 Oct. 8, 2009

(51) Int. Cl.
*F21V 17/02* (2006.01)
*F21V 14/08* (2006.01)

(52) U.S. Cl. ..... 362/512; 362/514; 362/539; 362/277

(58) Field of Classification Search ..... 362/512, 362/514, 507, 523, 487, 465, 538, 539, 277, 362/282, 280

See application file for complete search history.

(56) References Cited

U.S. PATENT DOCUMENTS

| | | | | |
|---|---|---|---|---|
| 5,769,525 | A | 6/1998 | Daumueller et al. | |
| 6,186,651 | B1 * | 2/2001 | Sayers et al. | 362/512 |
| 7,029,155 | B2 | 4/2006 | Bos et al. | |
| 7,201,504 | B2 * | 4/2007 | Collot et al. | 362/538 |
| 7,290,907 | B2 * | 11/2007 | Kovach | 362/512 |
| 7,712,934 | B2 * | 5/2010 | Kovach | 362/512 |
| 2001/0008486 | A1 * | 7/2001 | Futami | 362/512 |
| 2004/0184281 | A1 * | 9/2004 | Duarte et al. | 362/509 |
| 2006/0164851 | A1 * | 7/2006 | Collot et al. | 362/509 |
| 2007/0091630 | A1 * | 4/2007 | Eichelberger et al. | 362/512 |

FOREIGN PATENT DOCUMENTS

| | | |
|---|---|---|
| EP | 0 816 749 B1 | 9/2002 |
| EP | 1 177 939 B1 | 11/2007 |

* cited by examiner

*Primary Examiner* — Bao Q Truong
(74) *Attorney, Agent, or Firm* — Fay Sharpe LLP

(57) ABSTRACT

A high intensity discharge lamp automotive headlamp system is provided for three different lighting functions. The headlamp system is a single unit that provides for low beam, high beam, and daylight running light (DRL) functions. Two optical components are used to easily and effectively switch between the different modes of operation. The first optical component is a shutter that selectively blocks a portion of the light beam output. Secondly, either a single lens or lens portions can be moved either within the light beam path or into the light beam path to alter the divergence.

23 Claims, 5 Drawing Sheets

THREE-MODE INTEGRATED HEADLAMP

BACKGROUND

This disclosure relates to vehicle headlamp system, and more particularly a headlamp system that employs a high intensity discharge lamp in which three different lighting functions or modes are integrated into a single assembly. Selected aspects of this disclosure may find application in related headlamp arrangements and possibly find application outside of the headlamp art.

Discharge vehicle light sources are known in the art and are conventionally called xenon lamps. These discharge light sources are being used with increasing degree of penetration into the vehicle lighting market because of the advantageous benefits of higher luminous intensity, higher brightness, as well as lower power consumption as a result of the extremely high efficacy of the discharge lamps.

One downside of the xenon lamps is associated with the high cost of the lighting system. By way of the lighting system, a lighting system according to this disclosure includes the lamp, the headlamp unit (reflector, lenses, etc.), and the driving electronics of the lamp. The increased cost associated with discharge light sources has limited the penetration of these types of lamps into the mid-priced and low-priced vehicle classes. In part, an effective discharge headlamp assembly must be capable of performing multiple tasks or operating in multiple modes with a single unit. Some solutions provide for separate light sources between low beam and high beam applications or functions. More recently, so-called bi-xenon headlamp units perform low beam and high beam functions by applying a single xenon lamp system and mechanically switching the headlamp system architecture so that a change from a cut-off free high beam operation mode to a low beam operation mode with beam cut-off occurs.

U.S. Pat. No. 7,029,155 teaches a motor vehicle headlight that enables at least two functions to be obtained with a single structure, namely a daytime running light (DRL) function/mode and an infrared beam function/mode. Particularly, a reflector receives light from a high intensity discharge light source and directs the light in a beam where a filter is selectively positioned in the light path or light beam. The filter ensures sufficiently high absorption and spreading of the light beam. Thus, the headlight assembly operates in a first mode without the filter, and then operates in a second mode when the filter is situated in the light path. In a third mode of operation, an infrared filter is selectively disposed in the light path so that only an infrared beam is delivered.

In other instances, a separate incandescent light source is used to provide high beam operation while the high intensity discharge operation is provided for low beam operation. Alternately, the incandescent light source has been proposed as an auxiliary light source and located either inside or outside the headlamp unit to perform DRL operation mode. It will be appreciated that the use of a separate incandescent light source, whether incorporated within the headlamp assembly, or externally thereto, still adds additional cost to the lighting system. The additional light source also constrains the geometry and design of the headlamp, increases the headlamp wiring cost, and limits the freedom of design. Thus, although a bi-xenon discharge headlamp system may provide part of a solution of a single headlamp system between high beam and low beam modes of operation, discharge lamps, especially high intensity discharge lamps such as xenon automotive lamps, are difficult to dim. Dimming to power levels below sixty to seventy percent (60-70%) can potentially extinguish the arc at power levels well below the design value. Further, dimming to DRL operation mode where much less light is required further exacerbates the design issue of generating low light intensity in the headlamp that is still sufficient to be detectable at the required safety level by an oncoming car driver for the DRL operation mode, while simultaneously using the same headlamp system to achieve both low beam and high beam operation modes.

Thus, a need exists for a three-mode dimmable headlamp system that meets these needs and others in an efficient, effective, and cost competitive manner.

SUMMARY

A three-mode dimmable headlamp assembly uses a dimmable discharge light source driven by an adjustable ballast/igniter unit. A light projection unit includes a first optical component to modify light distribution for low beam application, and a second optical component modifying light distribution for DRL application together with dimming.

The headlamp lighting system includes a discharge light source, a reflector directing light from the light source outwardly as a light beam, a shutter movable relative to the reflector to switch between low and high beam modes, and means movable between first and second positions for changing a divergence of the light beam between the low/high beam modes and a daylight running light (DRL) mode.

The headlamp system further comprises means for selectively dimming the discharge light source when used in the DRL mode.

The system includes a shutter that selectively blocks at least a portion of the light beam in the low beam mode.

The headlamp system has a shutter that is mounted for selective rotation between the low and high beam modes.

In an alternate embodiment, the shutter selectively slides to provide low and high beam modes.

The light beam divergence changing means preferably includes a lens or an actuator for moving either the light source of the reflector mirror generally in the axial direction. The lens may be mounted for selective rotation between the low/high beam modes and the DRL mode, or selectively slides between the low/high beam mode and the DRL mode.

In another embodiment, the lens has a varying transparency in a radial direction.

The lens may include a coating that varies in thickness in a radial direction.

The method of providing low beam, high beam, and DRL functions with a single headlamp assembly having a discharge light source includes selectively blocking a portion of the light beam to switch between the high beam and low beam functions. Selectively changing the divergence of the light beam between the high/low beam mode and the DRL mode is also provided.

Selectively dimming the discharge light source also contributes to the DRL mode.

A major benefit of the present disclosure is the provision of a single headlamp system that operates effectively in three separate modes, namely, high beam, low beam, and DRL.

Another advantage is the ease with which the system switches between these functions.

Another advantage results in decreased production costs.

Still another advantage resides in the decreased space requirement of the headlamp.

Still another advantage is that since a discharge light source must be able to withstand high thermal shock when started, longer life of the light source is achieved. That is, the discharge light source is used in all three modes and when switched on for DRL mode and then switched to a high watt operation mode, the latter mode of operation can be effectively achieved more quickly and with lower thermal shock.

Still other advantages and benefits of this disclosure will become apparent from reading and understanding the following detailed description.

DETAILED DESCRIPTION OF THE PREFERRED EMBODIMENTS

Figure 1:
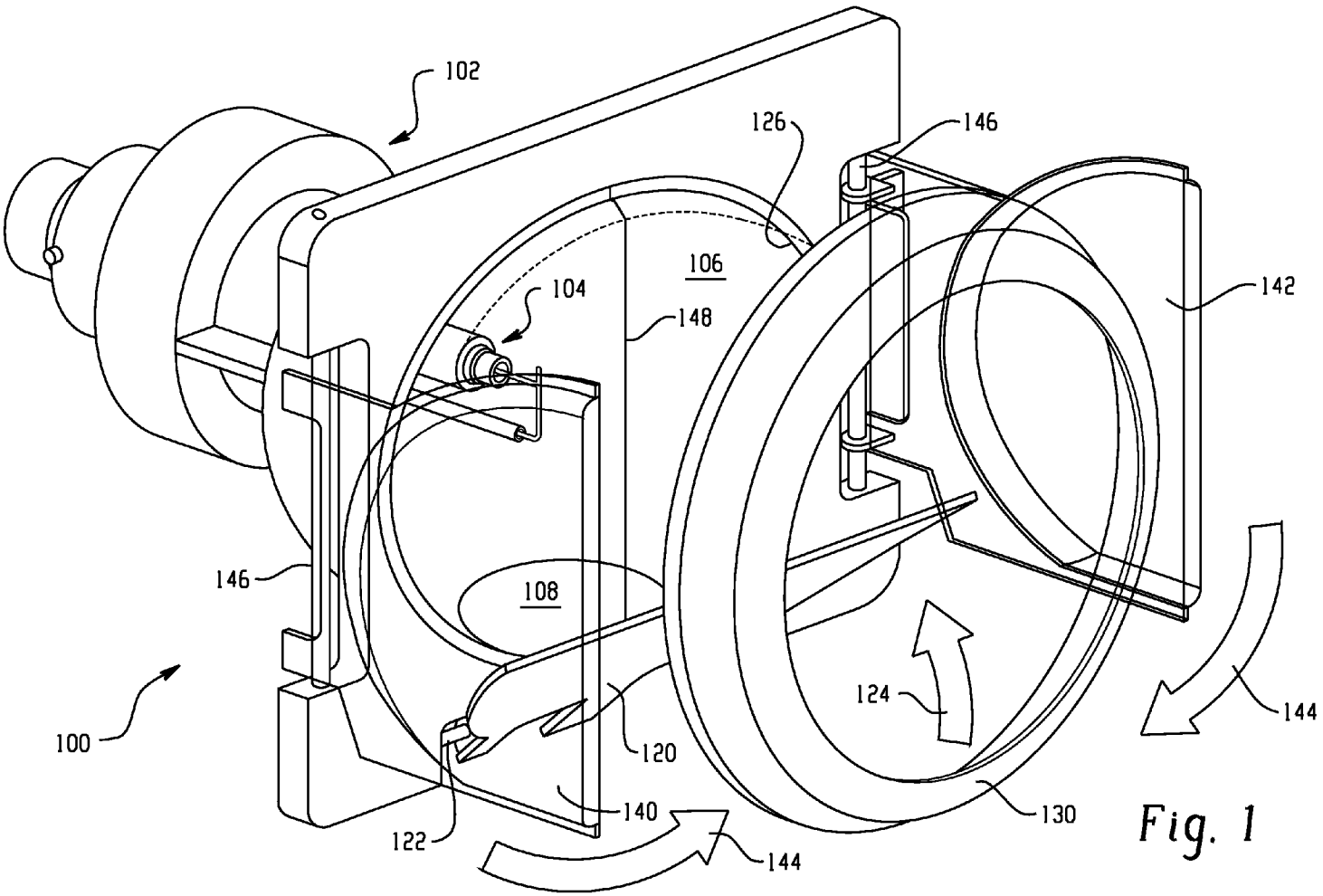
FIG. 1 is a perspective view of a first preferred embodiment of the headlamp system.

FIG. 1 shows a headlamp assembly 100 that includes a housing 102 enclosing a light source, preferably a high intensity arc discharge light source 104. The arc discharge light source may be any conventional arc discharge lamp suitable for a vehicle lighting application, or may be of the HID light source type as disclosed in the bi-xenon headlamp system as described in granted patents EP1177939B1; U.S. Pat. No. 5,769,525; and EP0816749B1, the details of which are incorporated herein by reference. A light transmissive envelope, such as a quartz envelope, encloses a fill that is selectively energized by applying an electrical potential between the oppositely spaced electrodes to create an arc. As illustrated in FIG. 1, in the preferred embodiment the electrodes are generally aligned along a longitudinal axis which is coincident with that of the housing and, more particularly, reflector surface 106. However, this arrangement of the electrodes or arc direction might be different in some particular lamp designs. The reflector surface in general is a surface of revolution. e.g., a paraboloid, ellipsoid, or other spheroidal surface that may or may not be distorted to become non-rotational symmetric, or may or may not be truncated as shown by plane 108. The reflector receives light emanating from the light source 104 and directs the received light outwardly in a desired direction and to form a light beam. For example, it is important that the light not include glare light directed toward oncoming drivers, and the particular beam pattern is also typically determined by existing regulations.

As will be appreciated, with the current high intensity discharge light sources for vehicle lighting, the light source provides between 2,700 and 3,600 lumens for low beam and high beam operation. The output of the light source itself is not altered between these two modes of operation. Rather, an opaque shutter designated here as shutter 120 attends to controlling light output from the system. The shutter is mounted to the housing for selective rotation about axis 122 and when rotated fully upwardly in the direction indicated by reference arrow 124 will cover approximately the lower one-half of opening 126 in the housing. With the shutter thus positioned in place, approximately one-half of the light from the discharge light source is effectively blocked from exiting the housing. Thus, the headlamp assembly effectively operates in low beam mode with the shutter in an upright or actuated position. When the vehicle driver requires high beam operation, this mode is achieved by moving the shutter 120 to a deactuated or inoperative position where the entire opening 126 is used to contribute to the light beam. In the current model of a bi-xenon reflector, a single metal shutter acts as an optical switch between high beam mode and low beam mode. When switching, this metal shutter plate moves up and down, blocking almost half of the beam in the low beam mode, and allowing the full beam to pass through the front lens 130 in high beam mode. It will also be appreciated that the high/low beam shutter 120 could be a shutter that is pushed inside or pulled outside the beam by an actuator, i.e., that is with a sliding movement.

In order to switch to the DRL mode, the beam divergence or beam intensity distribution must also be altered. To achieve this, one skilled in the art will be appreciate that the light source could be moved relative to the reflector. This is one way to "defocus" the light source relative to the reflector and thereby modify the beam output angle from the discharge lamp. Moving the light source in an axial direction to modify the beam and make it more divergent presents a more challenging design to an engineer and manufacturer. On the other hand, and as illustrated in FIG. 1, a lens may be selectively disposed within the light beam path. Here, first and second lens portions 140, 142 are rotatably mounted to the housing. These lens portions are shown in an open configuration in FIG. 1, although reference numerals 144 illustrate the desired directional movement where the lens portions pivot about respective axes 146, and where the shutters are then brought into aligned, covering relation relative to opening 126 in the housing. Dividing line 148 is present between the first and second lens portion when they are actuated into a position covering the opening 126 and across the light beam output from the headlamp. As shown here, the lens portions are two mating halves that are rotated into position. Alternatively, the lens could also be a single or one-piece lens, or a greater number of lens portions than two may be used to defocus the beam and increase its divergence. The lens is intended to be a transparent material in order not to lose significant beam energy, but rather only alter the beam divergence for use of the headlamp in the DRL mode. It may be desirable, for example, to coat the lens surface with a material that varies in thickness and which changes in the radial direction. For example, increasing the thickness of the coating at the edges would drop the transparency of the lens adjacent the edge thereof. In optics, this is called apodization and is effectively used to reduce the light diffraction from the edge of the lens. In any event, the transparent coating on the lens could be used to modify the intensity distribution of the light beam and thus meet the regulatory requirements for DRL beam divergence and intensity requirements.

As noted above, beam divergence can also be changed by moving the big front lens 130 in an axial direction to defocus the beam. This has the same effect as moving the light source out of focus, or axially moving the mirror relative to the light source, again to make the light source be purposefully out of focus. If an additional lens is used, where the lens is typically a divergent, concave lens, or half lens is introduced into the light beam, the embodiment of FIG. 1 or alternate embodiments of FIGS. 2-4 may be used. Still further, defocusing can be achieved by using three separate lens elements, at least one of which moves relative to the other two lenses as employed in a conventional zoom lens system. For example, one of the lenses could be the front lens 130 of the reflector. Defocusing is then achieved by either moving the central lens relative to the other two lenses or moving the first and third lenses relative to the fixed, second lens in the system and changing the effective focal length of the zoom lens system.

Figure 2:
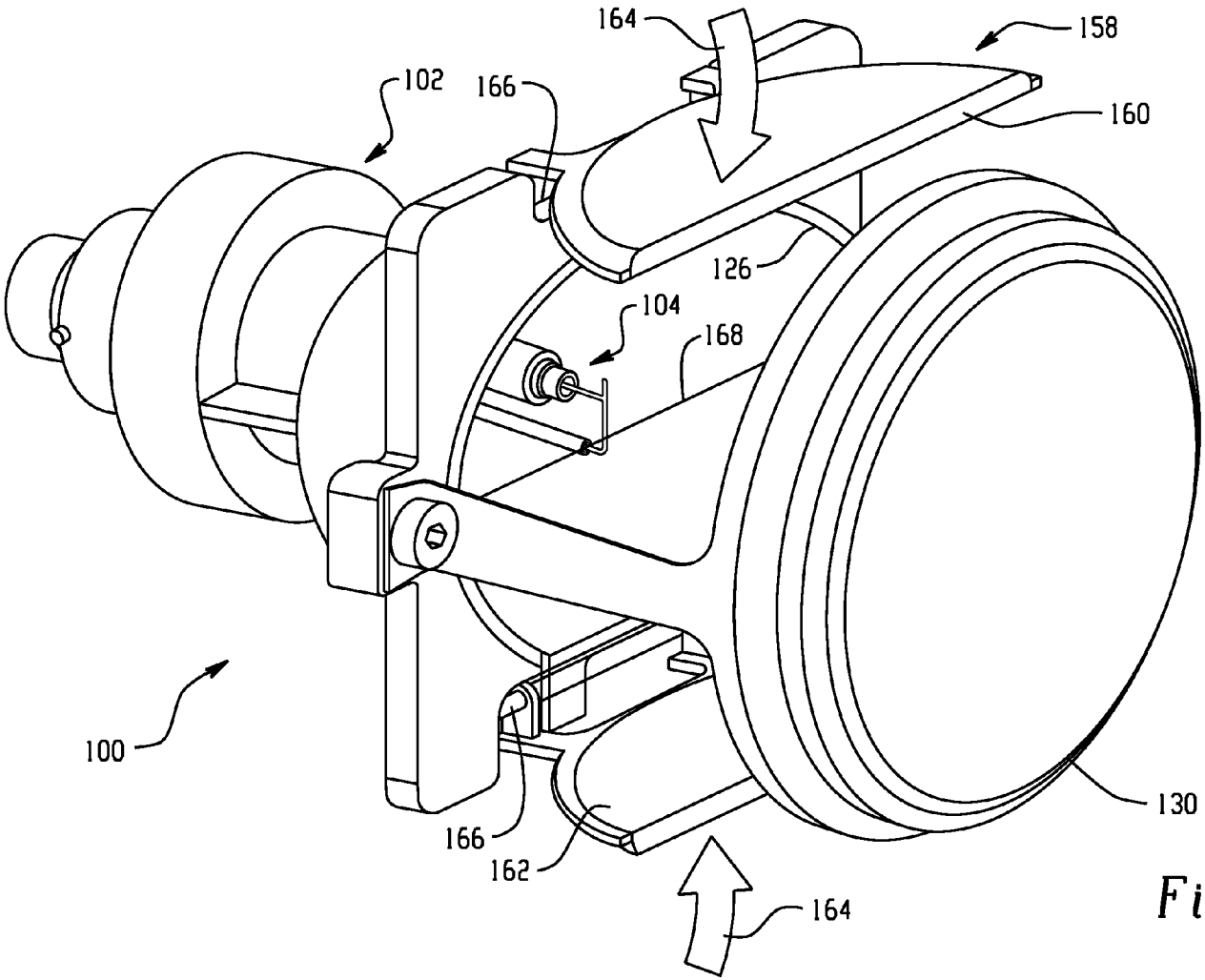
FIG. 2 is a view similar to FIG. 1, but employing lens portions that are rotated in an opposite direction.

As shown in FIG. 2, the shutter 158 is illustrated schematically and the emphasis is on the alternative configuration of the half lenses. Half lenses 160, 162 selectively rotate in the direction illustrated by arrows 164 about respective axes 166. Here, the axes 166 are disposed in a generally horizontal direction or at ninety degrees (90°) relative to the axes 146 of the FIG. 1 embodiment. In substantially all other respects, the structure and operation of FIG. 2 is identical to the embodiment of FIG. 1. When fully rotated into the path of the light beam, dividing line 168 is formed between the lens portions. It is also contemplated that the second or lower lens portion 162 is a shutter that effectively blocks light output from the lower semi-circular portion of the opening 126. Since light will only emanate through the upper half of the opening, only the first or upper lens portion 160 need be selectively introduced into the light beam to alter the divergence of the light for DRL mode operation.

Figure 3:
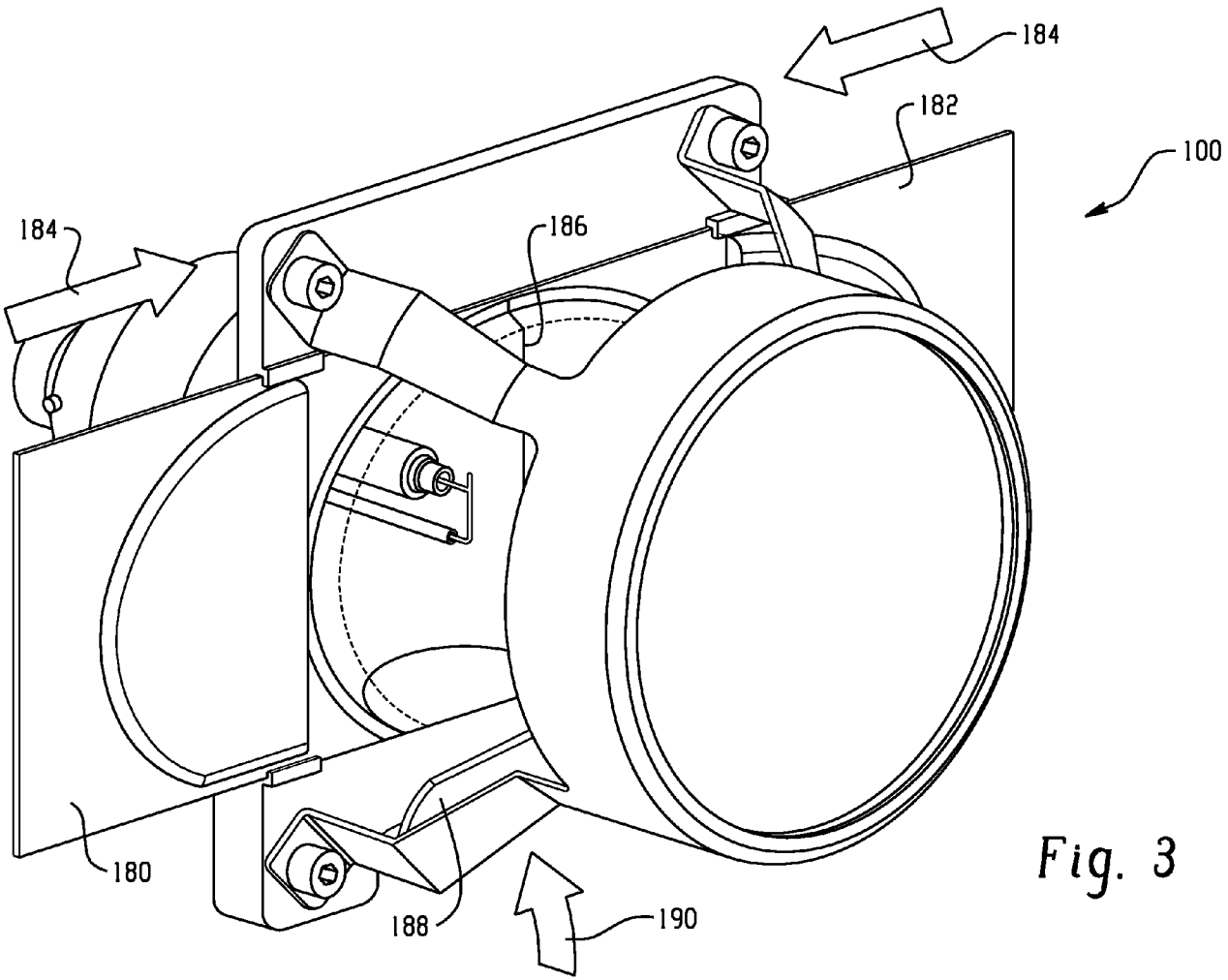
FIG. 3 is a perspective view of yet another embodiment where a shutter is rotated and lenses are selectively slid into position.

FIG. 3 is yet another embodiment where first and second lens portions 180, 182 are designed to selectively slide into the path of the light beam. In this particular instance, directional arrows 184 are representative of the actuating movement of the first and second lens portions 180, 182 into abutting relation along parting line 186. Further, shutter 188 is selectively rotated as evidenced by directional arrow 190 to again block the lower semi-circular portion of the opening for low beam operation. As will be recognized, in the high beam mode, the shutter 188 is moved out of the light beam and does not impact the light beam output. Again, in DRL mode, shutter 188 is rotated upwardly to block a substantial portion of the light output through opening 126 and the lenses 180, 182 are disposed to alter the divergence of the light beam.

Figure 4:
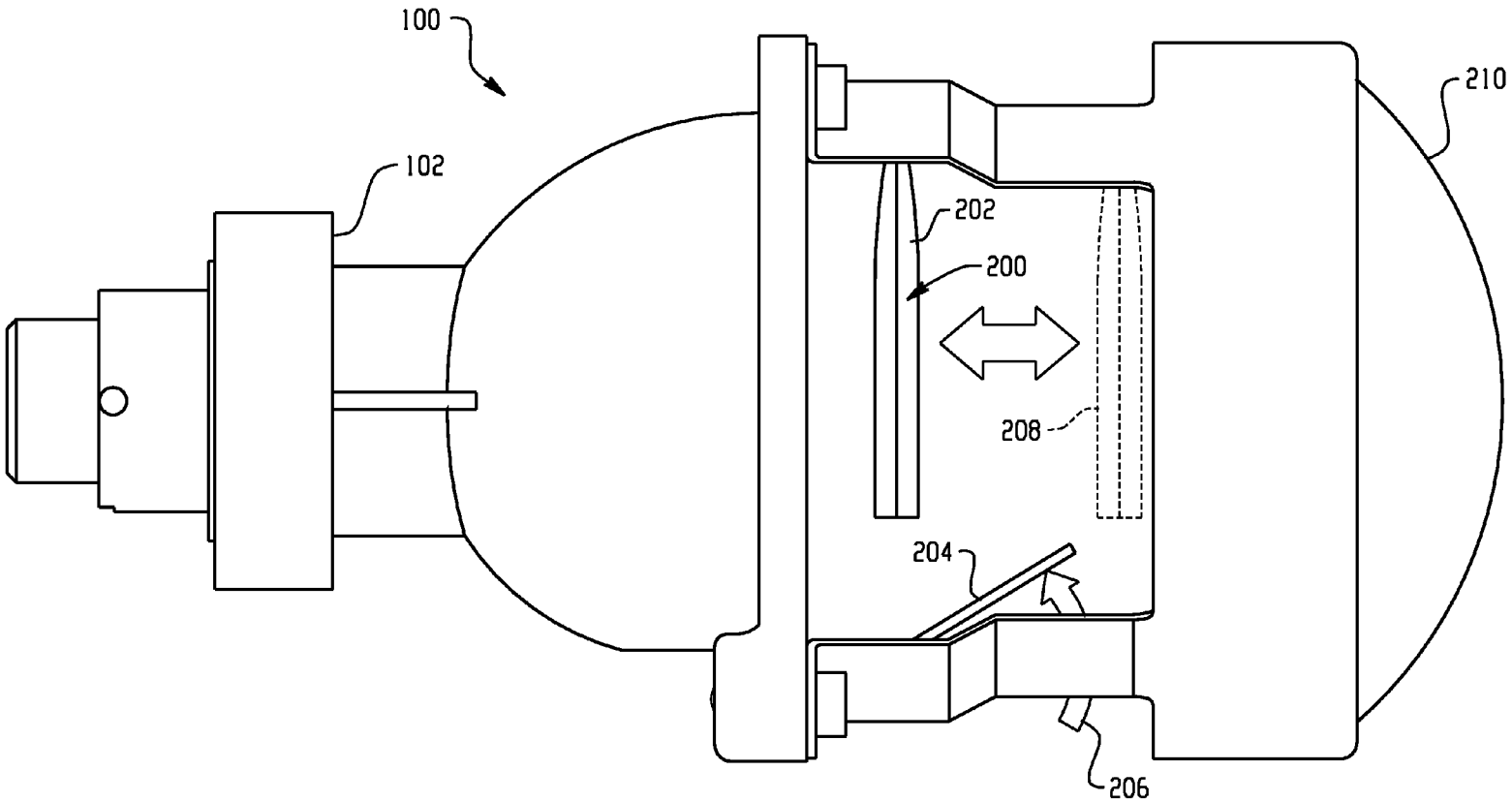
FIG. 4 is an elevational view of a fourth preferred embodiment, with a selectively rotatable shutter and an axially movable lens.

The embodiment of FIG. 4 provides for altered divergence in the DRL mode by moving a single lens 200 in an axial direction. Thus in a first or left-most position 202 as shown in FIG. 4, the lens provides the desired divergence for high beam mode. For low beam mode, shutter 204 is rotated upwardly as indicated by directional arrow 206 into the path of the lower semi-circular portion of the opening 126 of the headlamp housing. In the actuated shutter position, the headlamp then operates in the low beam mode. For the third mode, or DRL mode, the lens 200 is moved to the second or right-hand position 208. Moreover, the shutter 204 can also be moved upwardly to reduce the amount of light that leaves the headlamp assembly.

Alternatively, FIG. 4 may also be representative of a zoom lens system as alluded to above. That is, reference numeral 202 can refer to the first lens, reference 208 could refer to a movable lens portion, and the outer lens 210 could serve as the third lens of the assembly. That is, the first and third lenses 202, 210 would remain fixed in position, while the intermediate lens 208 would alter the focus or divergence of the light beam output.

Figure 5:
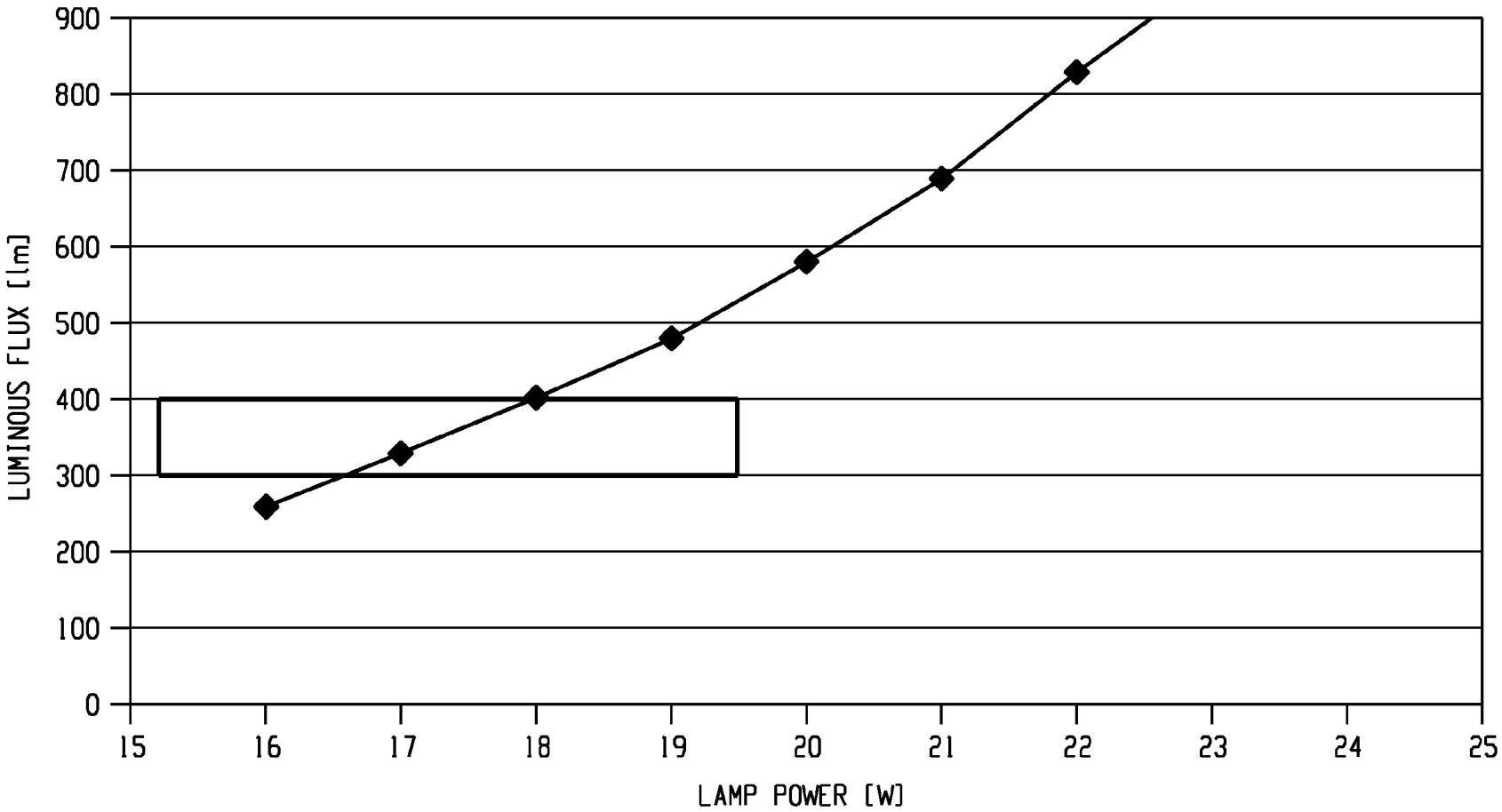
FIG. 5 is a graphical representation of lamp power relative to lumens associated with a high intensity discharge lamp.

The light intensity required for high beam, low beam, and DRL modes can be expressed in several physical units. For example, the curve of FIG. 5 illustrates lamp power versus lamp lumens where a HID vehicle lamp is dimmed down to luminous flux levels equal to the currently used incandescent lamps for DRL applications. The dimmed light level of 300 to 400 lumens is effective for DRL mode of operation. A lumen level of between 2,700 to 3,600 lumens is used for both the high beam and low beam applications. It is noted, however, that the required lumen level depends on the reflector design. That is, reflector efficiency and geometry both contribute to the reflector design and may alter the required lumen level of a particular headlamp assembly. Alternatively, light levels in the high beam and low beam modes are also given in lux units, which is an illuminance unit describing the strength of illumination (watts per square meter (watts/$m^2$)) of a reference screen. For the high beam, the center of the light beam is the brightest part and it has to meet a 100 lux unit specification by the current standards. In the low beam mode, the illuminance distribution is more complex and several points on the reference screen are defined. Some of them with a minimum lux value, i.e., where the driver wants to see the road, and others with a maximum lux value, e.g., in the direction of the oncoming traffic. In the DRL mode, beam intensity is the relevant physical measure, which is specified in candela units. That is, the aim of the DRL mode is not to illuminate the road surface in front of the vehicle, but rather to make the vehicle using the DRL mode headlamp operation detectable by other vehicles in the traffic stream.

In summary, a high intensity discharge lamp based automotive headlamp system is provided that includes three different lighting functions integrated into a single headlamp unit. The driver electronics of the dimmable discharge lamp can also be used to reduce the power output of the lamp in the DRL mode. The three functions are low beam, high beam, and daylight running light beam, which all use the same headlamp assembly with a series of shutters and lens/lenses to provide the desired light output, divergence, and intensity. It is easy to shift among these modes by altering the position of the lenses or shutters, i.e., by sliding or rotating between actuated and deactuated positions. This modifies the light distribution effectively and thereby achieves standard high/low beam operation or the added DRL light distribution in a third mode of operation.

In addition, the luminous output can be dimmed in a wide range of the light source by adjusting the ballast electric output to achieve the high/low beam or DRL light distribution and intensity. This solution eliminates the use of a separate incandescent or halogen incandescent light source as often proposed as an auxiliary light source for use either inside or outside the headlamp unit for DRL operation mode. Thus, the light projection unit features two optical components. The first optical component modifies the light distribution for low beam application, while the second optical component modifies the light distribution for DRL application, together with dimming. The DRL light distribution mode can be achieved by using additional lenses which are moved and used in several modes. Lenses can selectively rotate into the projected light path or the lenses selectively slide into the projected light path. Alternatively, the lens is moved in an axial direction of the projected light path. Using a linear actuator, the light source can also be moved out of position of high and low beam mode of operation to generate an altered light distribution.

Since the light source is always switched on for all three modes, the light source is pre-heated and can easily switch to high watt operation mode quicker with lower thermal shock. Where the lens is moved into the projected light path, simple actuators can move the lens axially, or rotate the lens or lens portions into position. Likewise, an electromagnetic actuator or piezo-translator can be used to achieve this function.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A headlamp lighting system for a vehicle comprising:

a discharge light source;

a reflector directing light received from the light source outwardly as a light beam;

a shutter moveable relative to the reflector to switch between low and high beam modes; and a projected beam divergence changing mechanism includes at least one lens moveable between first and second positions for changing a divergence of the light beam between the low/high beam modes and a daytime running light (DRL) mode.

2. A headlamp lighting system for a vehicle comprising:

a discharge light source;

a reflector directing light received from the light source outwardly as a light beam;

a shutter moveable relative to the reflector to switch between low and high beam modes;

a mechanism moveable between first and second positions for changing a divergence of the light beam between the low/high beam modes and a daytime running light (DRL) mode; and a mechanism that selectively dims the discharge light source when the system is used in the DRL mode.

3. The headlamp system of claim 2 wherein the discharge light source dimming means includes a mechanism that adjusts lamp luminous flux when switching between high beam and low beam mode.

4. The headlamp system of claim 3 wherein the discharge light source dimming mechanism includes a mechanism that modifies beam intensity.

5. The headlamp system of claim 1 wherein the shutter selectively blocks at least a portion of the light beam in the low beam mode.

6. The headlamp system of claim 1 wherein the shutter is mounted for selective rotation between the low and high beam modes.

7. The headlamp system of claim 1 wherein the shutter is mounted for selective sliding movement between the low and high beam modes.

8. The headlamp system of claim 1 wherein the lens is mounted for selective rotation between the low/high beam modes and the DRL mode.

9. The headlamp system of claim 1 wherein the lens is mounted for selective sliding movement between the low/high beam modes and the DRL mode.

10. The headlamp system of claim 1 wherein the lens is mounted for selective axial movement generally in a direction of the light beam between the low/high beam modes and the DRL mode.

11. The headlamp system of claim 1 wherein the lens includes first and second lens portions each moveable relative to the light beam.

12. The headlamp system of claim 1 wherein the divergence changing mechanism includes first, second and third lens mounted in optically cooperative relation for forming a zoom lens system.

13. The headlamp system of claim 12 wherein at least one of the first, second and third lenses is selectively moveable relative to at least one other of the first, second and third lenses.

14. The headlamp system of claim 13 wherein the second and third lenses are selectively movable relative to the first lens.

15. The headlamp system of claim 1 wherein the divergence changing mechanism includes a mechanism that moves the reflector relative to the light source.

16. The headlamp system of claim 1 wherein the divergence changing mechanism includes a lens that has a varying transparency in a radial direction.

17. The headlamp system of claim 16 wherein the lens includes a coating that varies in thickness in a radial direction.

18. A headlamp system for an automotive vehicle comprising:

a discharge lamp emitting light therefrom;

a reflector operatively associated with the lamp to receive the emitted light and direct reflected light in a controlled manner outwardly from the reflector;

a shutter operatively mounted relative to the reflector for selective movement between a high beam position that does not impact the reflected light and a low beam position that blocks at least a portion of the reflected light;

a lens operatively mounted relative to the reflector for selective movement between a high/low beam mode and a daytime running light (DRL) mode wherein the high/low and DRL modes have different light beam divergences; and a ballast for powering the discharge lamp including means for dimming the lamp in the DRL mode.

19. A method of providing low beam, high beam, and daytime running light (DRL) functions for an automotive headlamp assembly having a discharge light source that emits light and a reflector that directs emitted light from the light source into a desired light beam comprising:

selectively blocking a portion of the light beam to switch the headlamp assembly between the high beam and low beam functions;

selectively changing the divergence of the light beam between a high/low beam mode and DRL mode; and selectively dimming the discharge light source in the DRL mode.

20. The method of claim 19 wherein the light beam divergence changing step includes introducing a lens into the light beam.

21. The method of claim 19 wherein the light beam divergence changing step includes moving the lens in a general direction of the light beam.

22. The headlamp system of claim 1 wherein the projected beam divergence changing mechanism that moves the lens in a general direction of the light beam.

23. A headlamp lighting system for a vehicle comprising:

a single discharge light source;

a reflector directing light received from the light source outwardly as a light beam wherein the light source has a fixed position relative to the reflector;

a shutter moveable relative to the reflector to switch between low and high beam modes; and a mechanism moveable between first and second positions that changes a divergence of the light beam between the low/high beam modes and a daylight running light (DRL) mode.

* * * * *